US011759006B2

(12) United States Patent
O'Brien et al.

(10) Patent No.: US 11,759,006 B2
(45) Date of Patent: Sep. 19, 2023

(54) POWERED MODULAR DESKTOP ORGANIZER AND SYSTEM

(71) Applicant: AMAX INCORPORATED, North Kingstown, RI (US)

(72) Inventors: Holly O'Brien, Warwick, RI (US); Dennis Danville, Chepachet, RI (US); Noah E. Dingler, Phoenixville, PA (US); Andrew J. Miller, Phoenixville, PA (US); Julia Wright, Phoenixville, PA (US)

(73) Assignee: Amax Inc., North Kingstown, RI (US)

( * ) Notice: Subject to any disclaimer, the term of this patent is extended or adjusted under 35 U.S.C. 154(b) by 494 days.

(21) Appl. No.: 17/140,101

(22) Filed: Jan. 3, 2021

(65) Prior Publication Data

US 2021/0204689 A1 Jul. 8, 2021

Related U.S. Application Data

(60) Provisional application No. 62/957,110, filed on Jan. 3, 2020.

(51) Int. Cl.

| | |
|---|---|
| ***A47B 21/03*** | (2006.01) |
| ***A47B 21/04*** | (2006.01) |
| ***A47B 21/06*** | (2006.01) |

(52) U.S. Cl.

CPC ..... *A47B 21/0314* (2013.01); *A47B 21/04* (2013.01); *A47B 21/06* (2013.01); *A47B 2021/066* (2013.01)

(58) Field of Classification Search

CPC ..... A47B 21/0314; A47B 21/04; A47B 21/08; A47B 2021/066

See application file for complete search history.

(56) References Cited

U.S. PATENT DOCUMENTS

| | | | | |
|---|---|---|---|---|
| 4,802,593 A | | 2/1989 | Romanos | |
| 5,224,594 A | * | 7/1993 | Hou | B43M 99/001 206/214 |
| 5,265,735 A | * | 11/1993 | Hassel | B41J 29/16 211/11 |
| 5,588,727 A | | 12/1996 | D'Agaro et al. | |

(Continued)

OTHER PUBLICATIONS

Gather Modular Desk Organizer by Ugmonk, Minimalistic Wooden Desktop Sorter, from Amazon.com website, downloaded Jan. 3, 2020, pp. 1-3.

(Continued)

*Primary Examiner* — Patrick D Hawn

(74) *Attorney, Agent, or Firm* — Paul Y. Feng; ONE LLP

(57) ABSTRACT

A modular desktop organizer and system including a rectangular base with a tall superstructure and shallow side trays. The superstructure includes a U-slot for holding an upright smartphone with an inductive charger, and a deep cup for holding pens, scissors, and accessories. The base includes a channel-shaped tablet holder at the back. The base is electrically powered and includes USB ports. The modular components have a self-centering bias by way of a bottom bulge with a rounded periphery that nests within the top of another modular component having a complementary rounded lip. The modular components can be stacked to two, three or more levels high in an aligned and neat fashion due to the self-centering bias.

20 Claims, 6 Drawing Sheets

(56) References Cited

U.S. PATENT DOCUMENTS

| | | | | |
|---|---|---|---|---|
| 6,591,990 | B2 * | 7/2003 | Lanman | B43M 99/001 206/214 |
| 8,220,645 | B2 * | 7/2012 | Robinson | F21V 33/0048 211/11 |
| 8,408,402 | B2 | 4/2013 | Randby | |
| 8,899,797 | B2 | 12/2014 | Schaak | |
| 9,973,844 | B1 * | 5/2018 | Young | F16M 11/041 |
| 10,122,195 | B2 * | 11/2018 | Fochs | H02J 7/0045 D19/77 |
| 10,180,251 | B2 * | 1/2019 | Duque | F21V 33/0056 |
| 10,420,419 | B2 * | 9/2019 | Kasravi | B43M 99/008 |
| 10,454,289 | B2 * | 10/2019 | Chien | F21V 33/0004 |
| 11,228,187 | B2 * | 1/2022 | Romanenko | G06F 1/263 |
| 2007/0272629 | A1 | 11/2007 | Spirer | |
| 2009/0032479 | A1 * | 2/2009 | Robinson | B43M 99/009 211/11 |
| 2017/0155259 | A1 * | 6/2017 | Mecca | H02J 7/0044 |
| 2017/0174392 | A1 * | 6/2017 | De Loynes | A45C 7/005 |
| 2021/0204689 | A1 * | 7/2021 | O'Brien | B43M 99/008 |

OTHER PUBLICATIONS

Stealtho Office Innovations, 12-in-1 Modular Desk Organizer w/ Wireless Charger USB Hub, from eBay.com website, downloaded Jan. 3, 2020, pp. 1-2.

Hanghang Group, Desk Organizer Pen Holders Desk Stand Charger, from eBay.com website, downloaded Jan. 3, 2020, pp. 1-3.

* cited by examiner

POWERED MODULAR DESKTOP ORGANIZER AND SYSTEM

CROSS-REFERENCE TO RELATED APPLICATIONS

This non-provisional application claims benefit of priority from U.S. provisional application No. 62/957,110, filed on Jan. 3, 2020, the contents of which are hereby incorporated by reference.

FIELD OF THE INVENTION

The present invention is generally directed to a modular desktop organizer.

BACKGROUND

A typical desktop organizer is a tray with integrated cups, sunken storage cavities, open top receptacles, shelves, and the like, for organizing and storing office supplies such as pens, ruler, scissors, note pads, paper clips, coins, thumb tacks, adhesive tape, white out, etc. The organizer helps the user to maintain his or her desktop in an organized and uncluttered way, such that tiny items can be retrieved in a hurry. Examples of such desktop organizers can be found in, for example, U.S. Pat. No. 8,899,797 (Schaak), or U.S. Patent Application Publication Nos. 2007/0272629 (Spirer) and 2009/0032479 (Robinson).

SUMMARY OF THE INVENTION

The present invention is directed a modular, desktop organizer and system. The organizer and system in a preferred embodiment comprises a rectangular base with an integrated superstructure and one or more shallow side trays arranged side-by-side, wherein each tray includes a well with a rounded lip, and wherein the base includes a channel extending alongside, a PCB low voltage power supply disposed inside the base with electrical ports accessible from an exterior, and wherein the superstructure includes a cup with an elongated U-slot extending from the superstructure.

The organizer and system further include a plurality of modular components stackable to two, three or more levels on each other and on the shallow side tray or trays. Each modular stackable component includes a bottom bulge with a rounded periphery for self-centering bias within the well of the shallow tray. The modular components include, for example: a shallow opening cup; a deep opening cup; a housing containing at least one three-prong socket with a power supply, wherein the housing top includes a shallow tray with a rounded well; an LED light electrically connected to the PCB low power supply; a wireless, Bluetooth or wifi speaker electrically connected to the PCB low power supply or powered by an internal battery; and/or a headphone stand. An inductive charger or Qi charger may be incorporated into the superstructure.

The organizer offers stackable modular components to preferably utilize height for maximum storage capacity yet maintaining a small footprint on the user's desktop. Furthermore, the taller, larger mass superstructure provides stability for the base so it is less prone to accidentally toppling over, especially with stacked modular components nested thereon. And the U-slot of the taller superstructure can be used for docking a smartphone in a position to be used in a videoconferencing call.

The self-centering bias in the modular, stackable components may include a bottom bulge with a rounded periphery and a top with a rounded lip. These two complementary structures enable the components when stacked on each other to self-center. One or more of the shallow side trays may include wells with a rounded lip so the bulge fits within the respective well and self-centers within the tray. With very little attention from the user, the stacked modular components slip into alignment and neatly stack together. Because the modular components are biased to self-center, there is less likelihood of any modular components shifting out of position or toppling the stack.

DETAILED DESCRIPTION OF THE PREFERRED EMBODIMENTS

Figure 10:
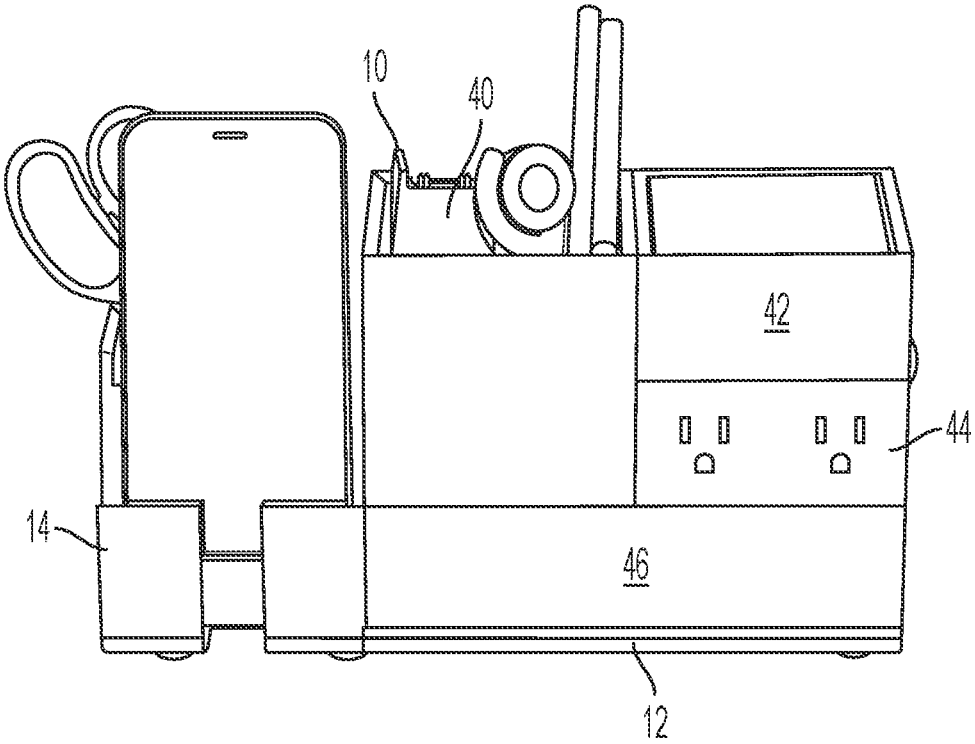
FIG. 10 is a front elevational view of a desktop organizer and system with modular components stacked thereon.

The present invention in various preferred embodiments contemplates a modular, desktop organizer and system. FIG. 10 shows a preferred embodiment system 10 that can hold a smartphone in a usable position such as for a videoconferencing call, and stackable components such as cups or bins for holding note pads, coins, paper clips, pens, tissue, memory cards, etc. The base, superstructure, and modular components are intended to be marketed as a kit or system. Specific modular components may be purchased by the end user as desired, such as a Bluetooth speaker for example. The end user is free to arrange the modular components as he or she desires, and to stack the modular components to multiple levels in height.

FIGS. 1-6 show a preferred embodiment base 12 with a tall, bulky superstructure 14. The base 12 includes two side trays 16 with shallow wells. The base 12 is preferably a rectangular shape, with the superstructure 14 located at one end and the two trays 16 arrange in line and side-by-side. Other arrangements are contemplated, such as with the superstructure in the middle and the side trays one on each side. There may be more or fewer than the two side trays shown.

Figure 1:
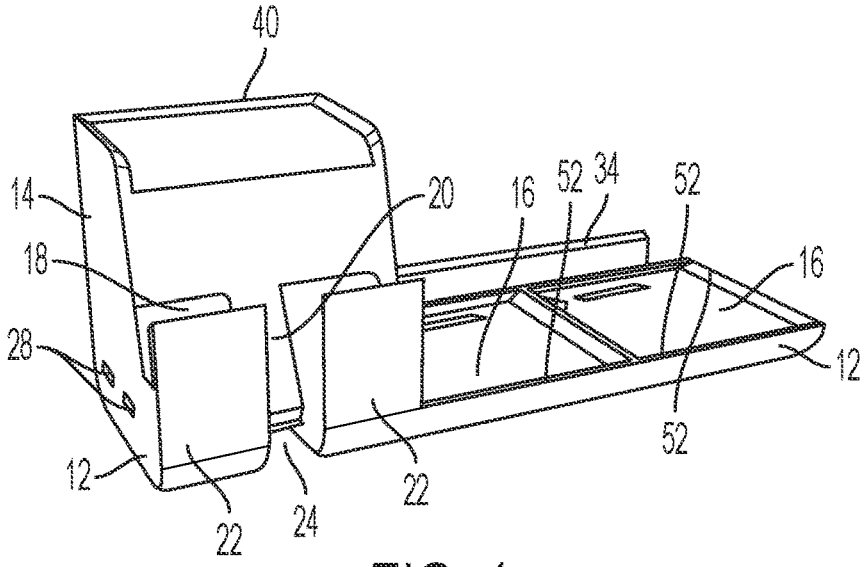
FIG. 1 is a front perspective view of a preferred embodiment base and superstructure.
Figure 2:
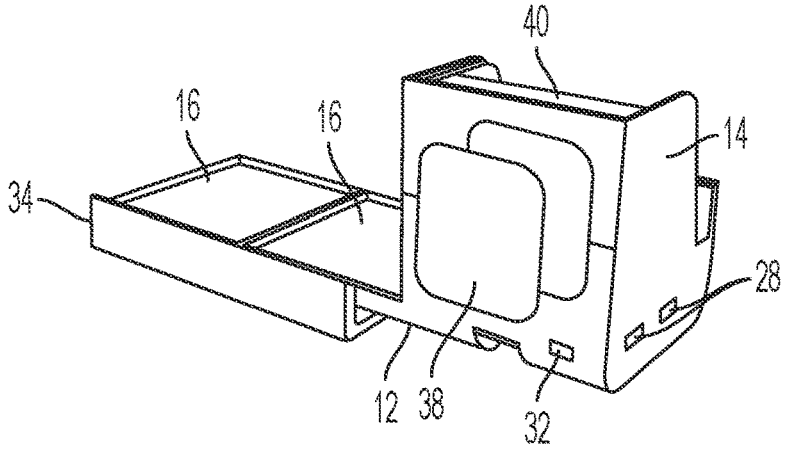
FIG. 2 is rear perspective view of the preferred embodiment base and superstructure of FIG. 1.
Figure 3:
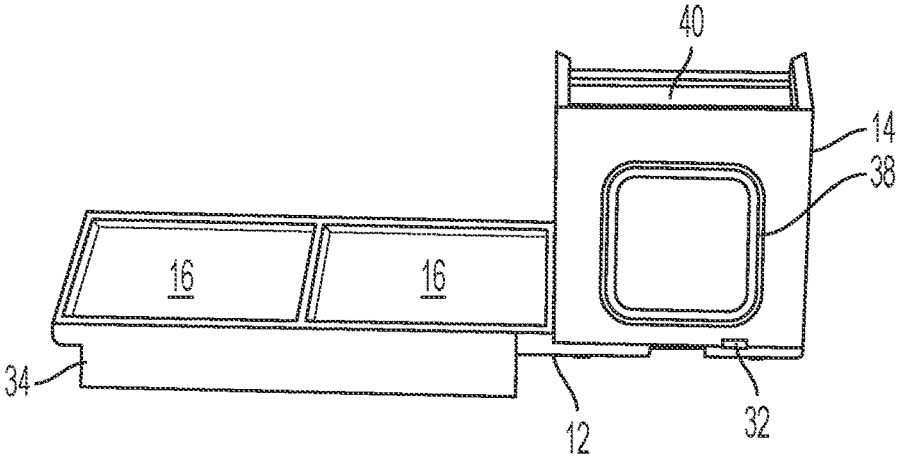
FIG. 3 is a rear view of the base and superstructure from FIG. 1.
Figure 4:
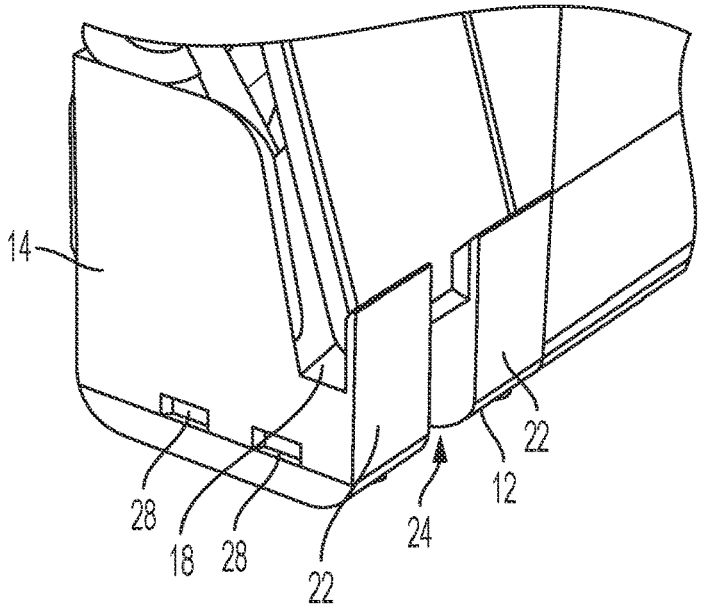
FIG. 4 is a magnified view of the U-slot used as a cell phone stand.
Figure 5:
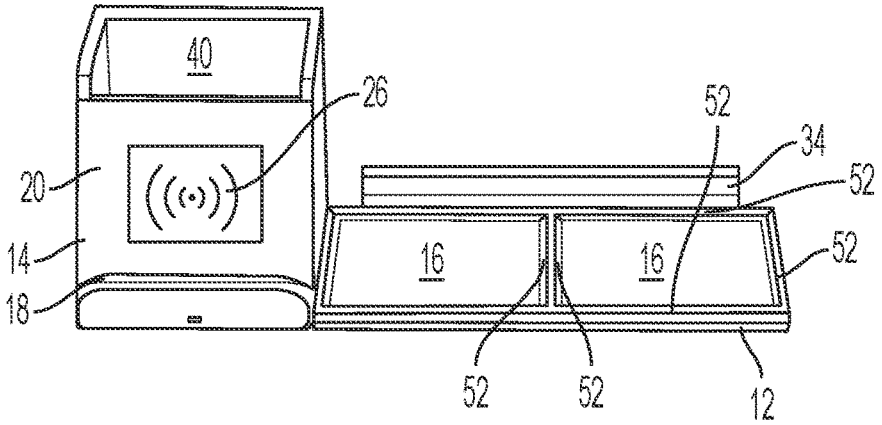
FIG. 5 is a front view of the base and superstructure with an inductive charger proximate the U-slot.
Figure 6:
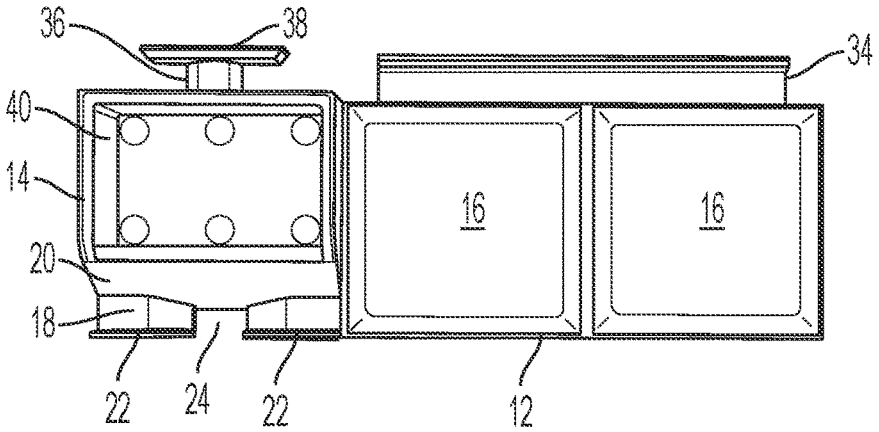
FIG. 6 is a top plan view of the base and superstructure.

FIGS. 1, 4 and 5 depict a front elevational view and FIGS. 5 and 6 depict rear elevational views of the base 12 and superstructure 14. The superstructure 14 preferably has a height, mass and girth to provide stability and a solid foundation for the desktop organizer. In a preferred embodiment, the organizer and system are intended to maintain a small footprint on the user's desktop, yet with stacking the modular components two, three, four or more levels upward, maximizing storage capacity of the organizer. The taller superstructure 14 is consistent with this preferred approach of building a skyscraper within a small footprint.

Further, the superstructure 14 optionally includes a tall and deep cup 40 as seen in FIGS. 1-6. The deep cup 40 typically serves as a pen holder, or may hold scissors, a laser pointer, a ruler, a desktop stapler, or similar heavier and bulky office accessories. The cup 40 within the superstructure 14 provides a stable container for such heavy objects so that the organizer is less likely to topple over. Further, when the cup 40 is loaded with heavy office accessories and supplies, it further stabilizes the entire organizer by its weight.

At the front of the superstructure 14, as shown in FIGS. 1, 4-6, is a U-shaped slot or U-slot 18. The U-slot preferably includes a sloped back wall 20 and a front with two panels 22 separated by an open center 24. This configuration allows a smartphone to by placed inside the U-slot 18, as in FIG. 4, where the smartphone is sloped so the smartphone's camera is angled toward the user's face, and the open center 24 ensures the smartphone's microphone and speakers are relatively unobstructed. The user is thus ready to partake in videoconferencing calls. The superstructure 14 may include a Qi or like inductive charger 16, preferably located at the sloped back wall 20 to be proximate the inductive coils of the cell phone. The weight of the cell phone cradled on the superstructure 14 further adds to the stability of the organizer and base.

Figure 7:
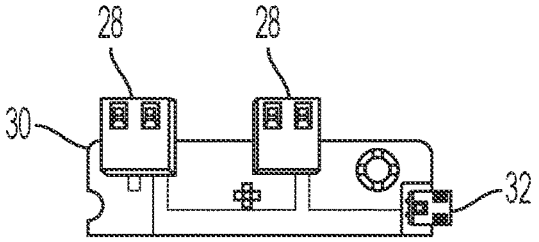
FIG. 7 is a top plan view of a PCB board.

The organizer 10 is electrically powered. At the side of the superstructure 14 are optional USB or like electrical ports 28 that may be used to charge accessories such as a smartwatch, backup battery, tablet, etc. A Printed Circuit Board 30 (PCB) low voltage power supply is present inside the base 12 or superstructure 14. The PCB 30 is wired to the USB ports 28 to output electrical power to the accessories connected or docked to the organizer and system 10 (such as the Qi charger 26). Input power to the PCB 30/organizer 10 is preferably supplied by a micro-USB port 32 at the back of the base 12, shown in FIGS. 1, 3, and 7. These all operate preferably at 5V DC power as per industry standard. The micro-USB port 32 receives power transmitted via a USB cord from a wall charger, an AC wall adapter, or like power supply (not shown).

Figure 13:
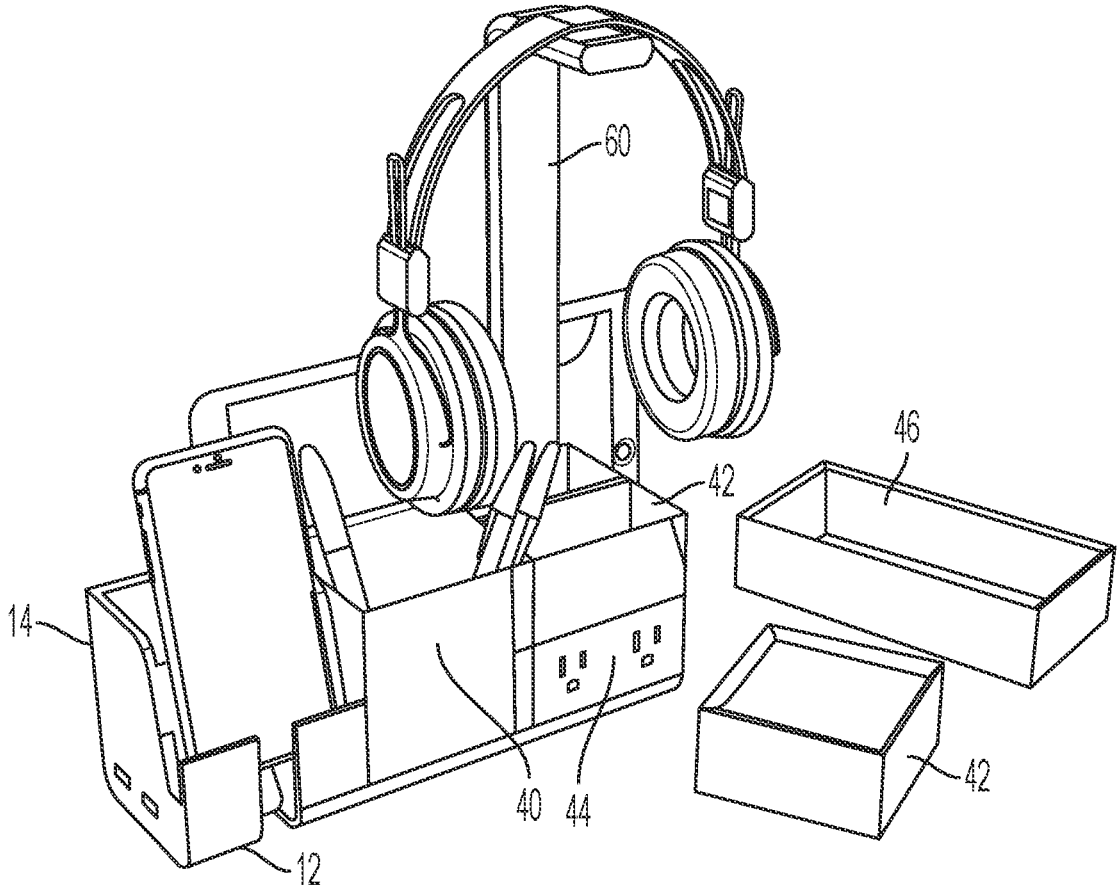
FIG. 13 is an alternative embodiment desktop organizer and system with a modular headphone stand.

As best seen in FIG. 6, the back of the base 12 includes a channel 34 disposed along an edge of the base, and a cantilevered rod 36 extending from the base 12 or superstructure 14. The channel 34 functions as a stand for a tablet, as seen in FIG. 13. The cantilevered rod 36 is a cord wrap for any accessories such as a charging cord for the tablet, or the excess length of the micro-USB cord can be wrapped and stored neatly away. The cantilevered rod 36 may have a stop 38 at its tip to help retain the wrapped cord thereon.

Figure 9:
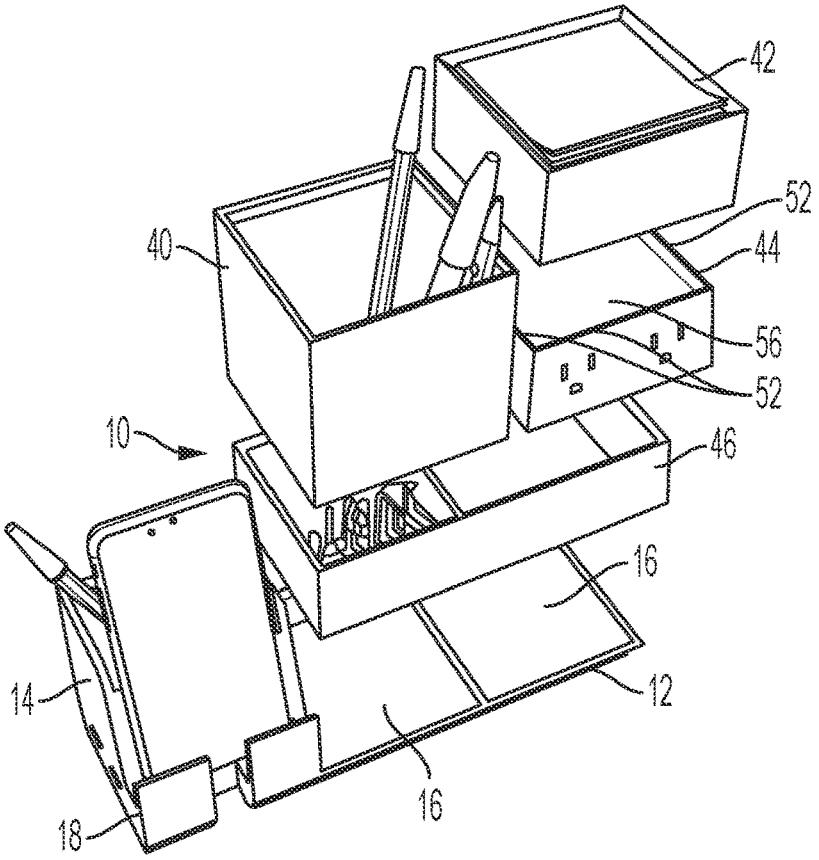
FIG. 9 is an exploded view of the preferred embodiment desktop organizer and system with a base, a superstructure, and stackable modular components.

FIGS. 9 and 10 show the preferred embodiment organizer and system 10 and how modular components may be stacked upon each other, on the base 12 and superstructure 14, or both to multiple levels. In these exemplary embodiments, the modular components include a deep square cup 40, a shallow square cup 42, a power supply housing 44, and a rectangular cup 46, all stacked up to three levels or more if desired. FIG. 10 shows the modular components stacked neatly together.

Figure 15:
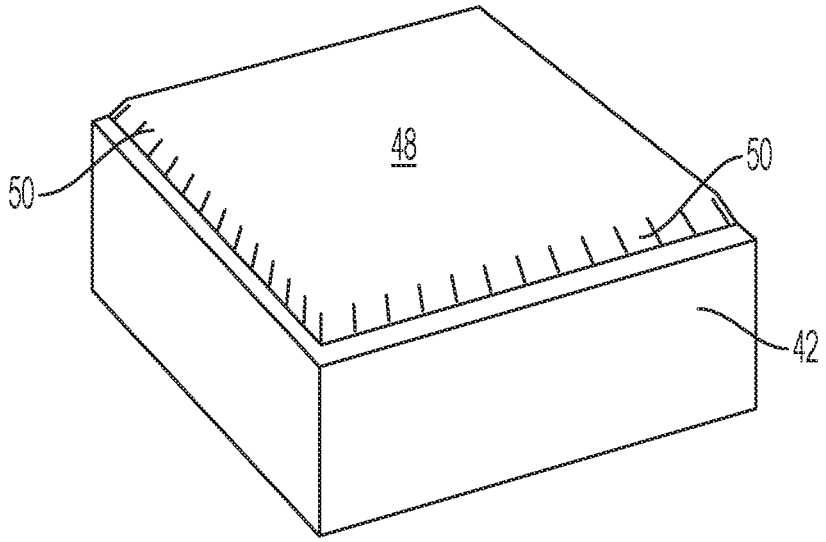
FIG. 15 a bottom view of a square cup showing a bottom bulge and a rounded or radiused periphery.
Figure 16:
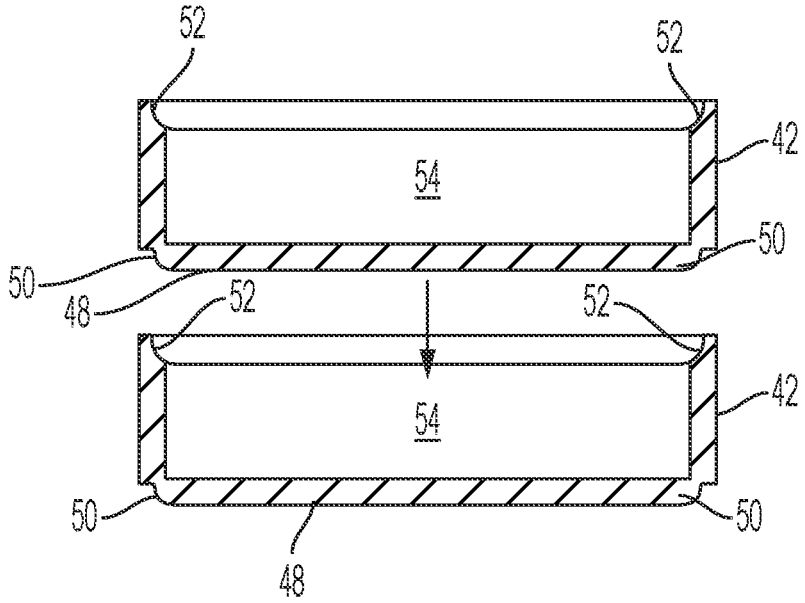
FIG. 16 is a cross-sectional view of a square cup stacked on top of another square cup where a budge of one fits within the rounded peripheral lip of the other to self-center.

To ensure easy and biased self-centering when the modular components are stacked, preferably each modular component has a bulge at its bottom with a peripheral radius and a lip with a curved or rounded lip around its circumference to receive the bulge therein. For example, FIGS. 15 and 16 depict a preferred embodiment means for this self-centering bias. FIG. 15 shows a modular component such as a square cup flipped upside down to reveal a bulged bottom 48 with a rounded periphery 50. FIG. 16 are cross-sectional views of two square cups 42 to be stack upon each other. The cross-sectional view shows the bulged bottom 48 of each cup 42 with a rounded or radiused periphery 50. At the open top 54 of the cup 42 is a rounded or radiused lip 52. Preferably, the radius of the rounded lip 52 matches or complements the radius of the rounded periphery for the budged bottom 48 to slip and self-center within the open top 54 of the cup 42. As seen in FIG. 16, the bulged bottom 48 preferably has a length, width, height dimensions for easy fitment inside the open top 54 of the cup 42 beneath. This together with the complementary radii of the rounded periphery 50 and rounded lip 52 provide the self-centering bias when the modular components are stacked together, with some help from gravity. The self-centering bias ensures when the user even casually stacks the modular components together, they all nest together and align neatly as seen in FIG. 10 without much effort or fiddling. The self-centering bias further ensures that when the modular components are stacked perhaps three or more levels high that there is no instability and the modular components are unlikely to topple over or collapse.

The side trays 16, as best seen in FIGS. 1 and 5, optionally include a self-centering means in the form of a rounded lip 52 circumscribing the well of each tray 16. The rounded lip 52 receives the rounded periphery 50 of the bulged bottom 48 of a cup 40, 42 or like modular component. Again, gravity and the rounded lip and periphery create the self-centering bias when the modular component nests within the well of each tray.

Figure 8:
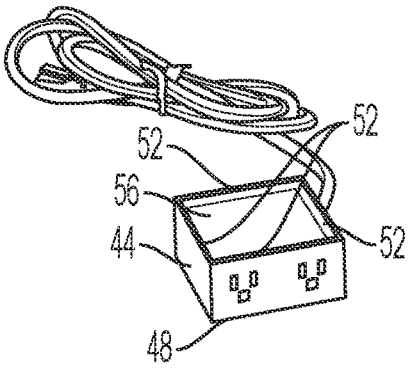
FIG. 8 shows a power supply housing.

FIGS. 8 and 9 show a preferably square shaped housing 44 for an AC electrical power supply. Specifically, it provides one or more sockets for a 120V AC plug. The back of the housing 44 includes a cable terminating in a plug to access a typical residential or office 120V AC socket. This housing 44 also includes a slightly sunken top surface or well 56 with a rounded lip 52 around its circumference. The housing 44 has a bulged bottom 48 with a rounded periphery similar to that shown in FIGS. 15, 16. Therefore, as seen in FIG. 9, 10, the housing 44 nests neatly on top of the rectangular cup 46 beneath, and a cup 42 nests neatly within the top surface 56 of the housing 44, all accomplished with minimal effort by the user due to the self-centering bias of these modular components.

Figure 11:
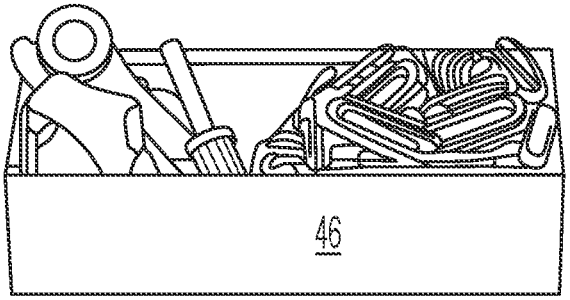
FIG. 11 is a modular component in the form of a rectangular cup.

FIG. 11 shows a modular component that is a rectangular cup 46, as used in the organizer 10 shown in FIG. 10. It has the self-centering means with two bulges and radiused periphery at its bottom to fit respectively inside the two wells of the side trays 16. The open top includes a rounded lip 52.

Figure 12:
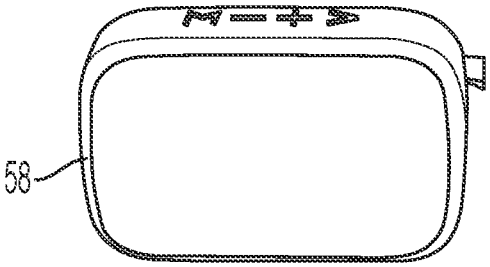
FIG. 12 is a modular component in the form of a wireless, wifi or Bluetooth speaker.

FIG. 12 shows a modular component that is a wireless speaker 58. It can receive a signal via Bluetooth, wifi, or the like. It may be powered by an internal rechargeable battery and includes the self-centering bias means on its housing so it can nest on any other modular component.

FIG. 13 shows an alternative embodiment arrangement of the present invention organizer and system that includes a headphone stand 60 that may extend from the base 12, or it may have its own support with self-centering means that nests within a cup 42, for example. The system 10 may be marketed to the consumer as a kit with any combination of modular components as shown here. The shallow cup 42 and rectangular cup 46, as well as other modular components, may be separated from and used individually away from the base 12. The organizer and system of FIG. 13 has a stand 60 for wireless headphones, and docking areas for a tablet and a smartphone, plus a deep cup 40 for holding pens, and a shallow cup 42 for holding note paper.

Figure 14:
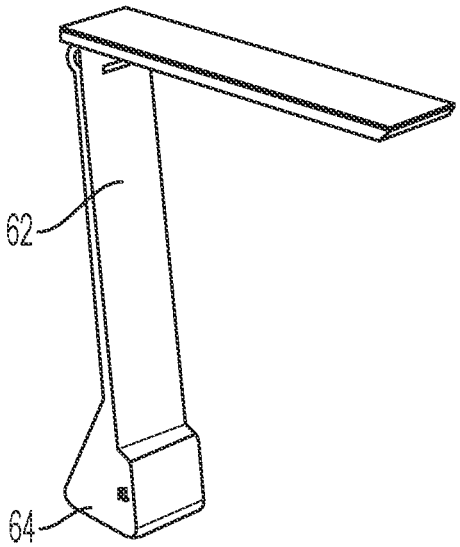
FIG. 14 is a modular component in the form of an LED desk lamp.

FIG. 14 shows a modular component in the form of an LED lamp 62. The lamp base 64 may be shaped to fit into the organizer base 12 or within the deep cup 40 of the superstructure 14, and further wired to the low voltage USB power source 30. The LED lamp 62 may also be battery powered so there is no need to tap into the power source of the organizer base 12.

The present invention modular desktop organizer and system preferably includes a base and modular components fabricated to include Acrylonitrile Butadiene Styrene (ABS), silicone, wood, metal, or any combination thereof. The plastic material may be opaque, translucent, or transparent. When transparent, the user can see what is inside a modular component when nested within the stack without unstacking. Furthermore, the surface of the material is preferably finished or selected to have a low coefficient of friction—such as for ABS plastic—to enhance the self-centering bias. Thus, stacked modular components easily slide into relative position within a well, rounded lip, etc., for alignment.

The preferred embodiment base has a rectangular shape, and most of the components have a square or rectangular shape for easy stacking. However, it is contemplated that other shapes (other polygons, ovals, etc.) can be used insofar as they preferably include a self-centering means, modular interchangeability, and/or stackable capability.

While the particular preferred embodiments of the invention have been illustrated and described, it will be apparent that various modifications can be made without departing from the spirit and scope of the invention. It is contemplated that elements from one embodiment may be combined or substituted with elements from another embodiment.

What is claimed is:

1. A modular, desktop organizer and system, comprising:

an elongated base with a tall superstructure and a shallow side tray, wherein the tray includes a rounded lip well, and wherein the base includes a channel extending alongside an edge, a PCB low voltage power supply disposed inside the base with electrical ports accessible from an exterior, and wherein the superstructure includes a tall cup with an elongated U-slot extending from the superstructure;

a plurality of modular components stackable on each other and on the shallow side tray, wherein the modular components each includes a bulge with a rounded periphery at a bottom and a rounded lip at a top for self-centering bias, and wherein the modular components include at least one of:

a shallow opening cup;

a deep opening cup;

a housing containing at least one three-prong socket with an AC power supply, wherein the housing top includes a well with a rounded lip and the bottom includes a bulge with a rounded periphery;

an LED lamp electrically connected to the PCB low power supply;

a wireless speaker; and a headphone stand.

2. The modular, desktop organizer and system of claim 1, wherein the superstructure includes a Qi charger disposed proximately to the U-slot.

3. The modular, desktop organizer and system of claim 1, wherein the base includes two side trays and wherein the superstructure and the at least two shallow side trays are arranged side-by-side.

4. The modular, desktop organizer and system of claim 1, wherein the modular components are stackable to more than two levels.

5. The modular, desktop organizer and system of claim 1, wherein the base and modular components include at least one of a translucent material and a transparent material.

6. The modular, desktop organizer and system of claim 1, wherein base and modular components include a material selected from the group consisting of Acrylonitrile Butadiene Styrene (ABS), silicone, wood, or metal.

7. The modular, desktop organizer and system of claim 1, wherein the base and superstructure include a front facing a user and a back facing away from the user, wherein the front includes the U-slot and the back includes the cantilevered rod and the channel.

8. The modular, desktop organizer and system of claim 1, wherein the rounded periphery at the modular component bottom includes a first radius and the rounded lip at the modular component top includes a second radius, and the first and second radii are matched for self-centering bias.

9. The modular, desktop organizer and system of claim 1, wherein the base, superstructure, and modular components include a polymer with a low coefficient of friction.

10. A modular, desktop organizer and system, comprising:

a rectangular base with an integrated superstructure and two shallow side trays arranged side-by-side, wherein each tray includes a well with a radiused lip, and wherein the base includes a channel extending alongside, a PCB low voltage power supply disposed inside the base with electrical ports accessible from an exterior, and wherein the superstructure includes a cup with an elongated U-slot extending from the superstructure;

a plurality of modular components stackable on each other and on the shallow side trays, wherein the modular stackable components each includes a bottom bulge with a radiused periphery and a top with a radiused lip for self-centering bias within the rounded well of the shallow tray and other modular components, and wherein the modular components further includes at least one of:

a shallow opening cup;

a deep opening cup;

a housing containing at least one three-prong socket with a power supply;

an LED light electrically connected to the PCB low power supply;

a wireless speaker; and a headphone stand.

11. The modular, desktop organizer and system of claim 10, wherein the superstructure includes an inductive charger disposed proximately to the U-slot.

12. The modular, desktop organizer and system of claim 10, wherein the U-slot extending from the superstructure is further comprised of a sloped back and a front with two panels separated by an open center.

13. The modular, desktop organizer and system of claim 10, wherein the radiused lip of the well complements the radiused periphery of the bottom bulge.

14. The modular, desktop organizer and system of claim 10, wherein the cup of the superstructure includes a top opening with a radiused lip to complement the radiused periphery of the modular component bottom bulge.

15. A modular, desktop organizer and system, comprising:

a rectangular base having an integrated superstructure and at least two shallow side trays arranged side-by-side, wherein each tray includes a means for self-centering bias receiving a first modular component therein, and wherein the base includes a channel extending alongside the platform, a cantilevered rod extending from the superstructure, a PCB low voltage power supply disposed inside the base with electrical ports accessible from an exterior, and wherein the superstructure includes a deep cup and an elongated U-slot extending from the superstructure;

the first modular component disposed on one of the at least two shallow side trays, wherein the first modular component includes a top with the means for self-centering bias, and a bottom with the means for self-centering bias; and a second modular component stacked on top of the first modular component, wherein the second modular component includes a top with the means for self-centering bias, and a bottom with the means for self-centering bias.

16. The modular, desktop organizer and system of claim 15, wherein the means for self-centering bias at the top of the first modular component includes a rounded lip.

17. The modular, desktop organizer and system of claim 15, wherein the means for self-centering bias at the bottom of the first modular component includes a bulge with a rounded periphery.

18. The modular, desktop organizer and system of claim 15, wherein, in the second modular component, the top means for self-centering bias includes a rounded lip, and the bottom means for self-centering bias includes a bulge with a rounded periphery.

19. The modular, desktop organizer and system of claim 15, wherein the means for self-centering bias of the at least two shallow side trays include a rounded lip.

20. The modular, desktop organizer and system of claim 15, wherein the means for self-centering bias include complementary radii.

* * * * *